US006101963A

United States Patent [19]

Shen et al.

[11] Patent Number: 6,101,963

[45] Date of Patent: Aug. 15, 2000

[54] RUDDER TAB FOR SUPPRESSION OF TIP VORTEX CAVITATION

[75] Inventors: Young T. Shen, Potomac; Scott Gowing, North Potomac, both of Md.

[73] Assignee: The United States of America as represented by the Secretary of the Navy, Washington, D.C.

[21] Appl. No.: 09/307,421

[22] Filed: May 10, 1999

[51] Int. Cl.[7] ..... B63B 3/38

[52] U.S. Cl. ..... 114/140; 114/126; 114/162; 114/274

[58] Field of Search ..... 114/162, 140, 114/126, 127, 274

[56] References Cited

U.S. PATENT DOCUMENTS

| | | | |
|---|---|---|---|
| 3,230,920 | 1/1966 | Pislorz-nalecki | 114/162 |
| 3,753,415 | 8/1973 | Burtis | 114/127 |
| 4,050,397 | 9/1977 | Vanderleest | 114/274 |
| 5,415,122 | 5/1995 | Shen . | |
| 5,456,200 | 10/1995 | Shen . | |

FOREIGN PATENT DOCUMENTS

| | | | |
|---|---|---|---|
| 316971 | 4/1934 | Italy | 114/162 |

*Primary Examiner*—Sherman Basinger
*Attorney, Agent, or Firm*—John Forrest; Jacob Shuster

[57] ABSTRACT

Cavitation of a hydrofoil element, such as the rudder of a marine vessel, from exposure to a body of water during onset flow at different angles to the chordal axis of the rudder profile, is suppressed by a tab on the lower end tip of the rudder. Such tab has external surfaces thereon which affect flow separation relative to the rudder so as to suppress or delay cavitation.

10 Claims, 4 Drawing Sheets

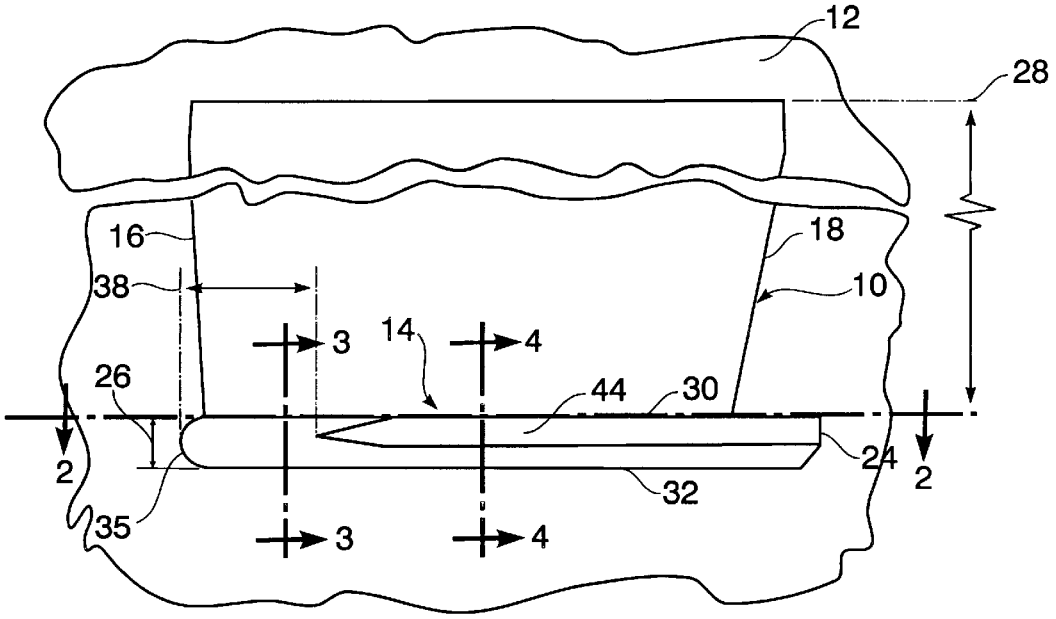
FIG. 1
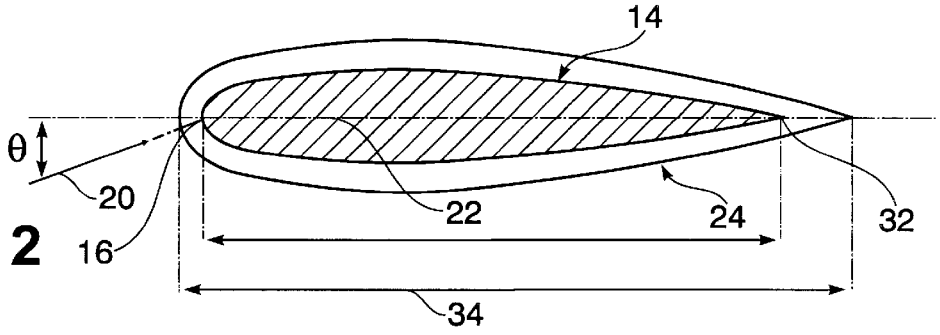
FIG. 2
FIG. 3
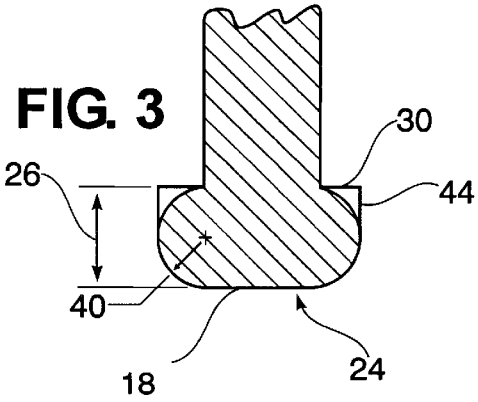
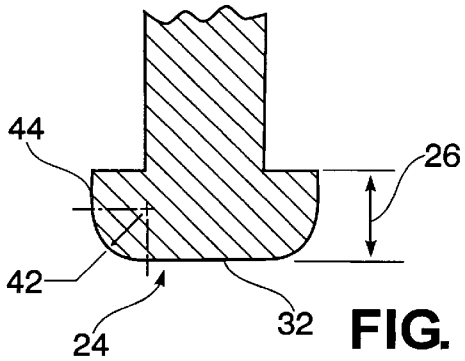
FIG. 4

RUDDER TAB FOR SUPPRESSION OF TIP VORTEX CAVITATION

The present invention relates generally to hydrofoil elements such as marine craft rudders, fluid pump or turbine impellers and blade tips of marine propellers through which lift or thrust is generated by movement of such elements relative to surrounding fluid such as water through which such elements are subject to surface cavitation from exposure to the fluid.

BACKGROUND OF THE INVENTION

Cavitation, a major source of radiated noise from marine craft such as surface ships, increases the total noise generated during ship operation and reduces sonar sensing capability. Cavitation is also a source of ship hull vibration and a cause of surface erosion which increases maintenance costs. The marine craft rudder environment for the foregoing cavitation problems are set forth as background in prior U.S. Pat. Nos. 5,415,122 and 5,456,200 to one of the inventors of the present invention which has as an important object thereof the suppression of cavitation associated with cavitation patterns on the sides of a generally conventional or typical rudder on marine vessels.

SUMMARY OF THE INVENTION

In accordance with one embodiment of the present invention, a typical rudder on the bottom of a marine craft or vessel within a body of water, has a tab fixed to its lower end tip. Such tip tab has a hydrofoil type of profile shape along its chordal axis similar to but larger than that of the chordal profile of the rudder at its lower end tip so as to project forwardly, rearwardly and laterally therefrom. The forward leading portion of the tab between its upper and lower edges projects laterally from the end tip along side faces that are rounded in accordance with a radius equal to one-half of the uniform vertical thickness of the tab throughout. Such tab thickness is approximately 2% of the rudder span so as to suppress or avoid tip nose cavitation up to the maximum projected speed of the marine vessel. The rounded leading portion of the tab also extends along approximately 10% of the tab chordal length from its forward nose end to avoid cavitation from severe peak suction pressure produced along the forward portion of the rudder tip that is 3% of its chordal length. Cavitation on or near the tab or forward protion of the rudder is thereby avoided even during large flow angle of attack on the rudder. Rearwardly from such rounded leading portion of the tab, the top edge thereof extending to the trailing edge of the rudder also extends laterally from the rudder along flat surfaces to form sharp corners with flat side surfaces of the tab from which a rounded bottom edge surface extends throughout the tab between pressure and suction sides thereof for suppression of both pressure and suction vortex cavitation along the lateral sides of the rudder and the tab.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 1 is a partial side elevation view of a marine vessel rudder, with a cavitation suppression tab on the lower end tip of the rudder within a body of water;

FIG. 2 is a section view taken substantially through a plane indicated by section line 2—2 in FIG. 1;

FIGS. 3 and 4 are partial section views respectively taken substantially through planes indicated by section lines 3—3 and 4—4 in FIG. 1.

DETAILED DESCRIPTION OF PREFERRED EMBODIMENT

Figure 5:
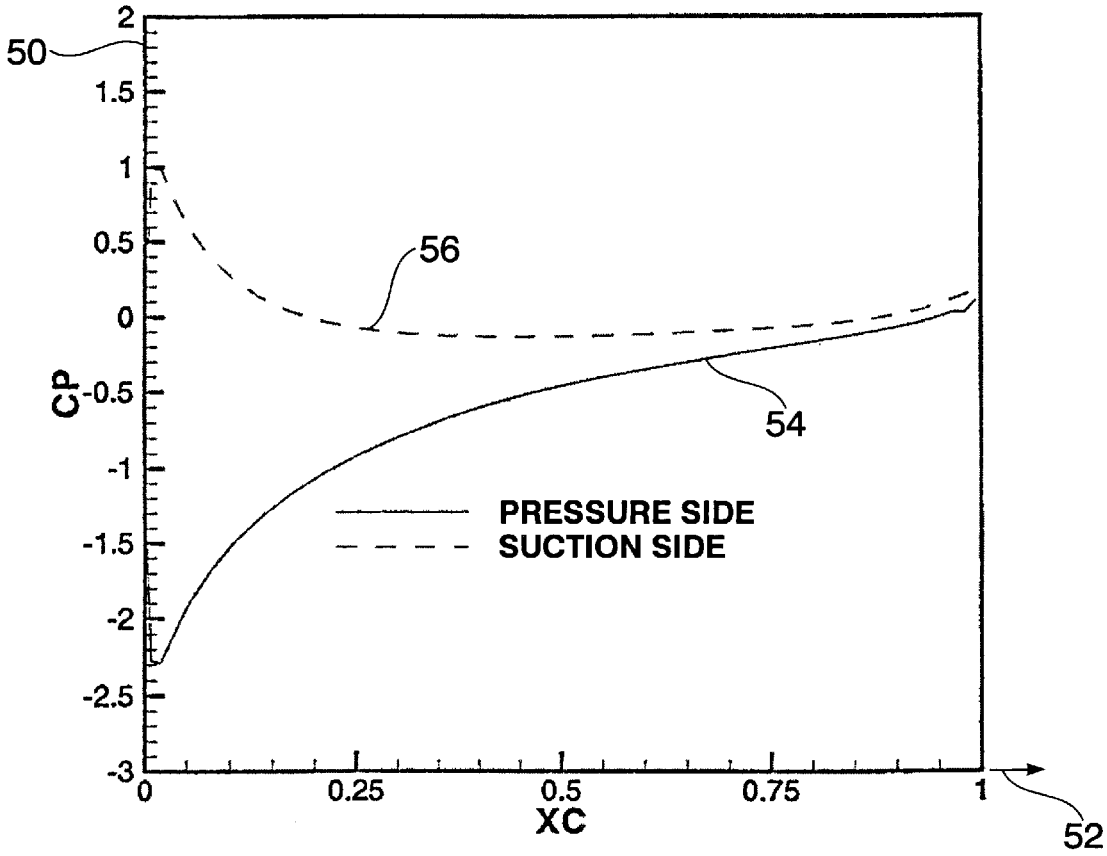
FIGS. 5, 6A, 6B, 7A and 7B are graphical representations of cavitation inducing conditions resulting from tests related to the marine vessel rudder environment depicted in FIGS. 1–4.

Referring now to the drawing in detail, FIG. 1 illustrates a hydrofoil element in the form of a conventional rudder 10, extending downwardly from its root 11 attached to the bottom of a marine craft or vessel 12 within a body of water 13. The rudder 10 has a typical cross-sectional profile terminating at its lower end tip 14 as shown in FIG. 2. Such profile extends horizontally along a chordal axis 22 between a leading edge 16 of the rudder and a trailing edge 18. As also shown in FIG. 2, the rudder 10 is experiencing flow of the surrounding water relative thereto along a flow direction 20 at some angle of attack θ, such as 10° to its chordal axis 22. Such flow direction angle of attack θ is established by rudder rotation for maneuvering and control of the marine craft 12. The relative flow of water is induced by propulsion of the marine craft 12 and/or rotation of propellers (not shown) located forwardly of the rudder.

In accordance with the present invention, a tab 24 is fixed to the rudder at its lower end tip 14, and has an outer profile shape geometrically similar to but uniformly larger throughout than the profile of the rudder tip 14 as shown in FIG. 2. As shown in FIG. 1, the tip tab 24 has a uniform thickness 26 throughout between a top edge 30 and a bottom edge 32, of a length 34 along the chordal axis 22 larger than the length 36 of the rudder tip 14. The thickness 26 of the tab 24 is selected to be 2% of the vertical rudder span 28 between its root 11 and tip 14. The tab 24 also extends forwardly from the leading edge 16 of the rudder and rearwardly from the trailing edge 18 at the end tip 14 in the illustrated embodiment.

At the forward end of the tab 24, it has a rounded nose 35 from which the tab extends rearwardly a distance 38, as denoted in FIG. 1, that is 10% of the tab chordal length 34. Such 10% rounded nose portion of the tab has semi-circular side faces in cross-section between the top and bottom edges 30 and 32 as shown in FIG. 3. The radius 40 of such semi-circular side faces of the rounded nose portion of the tab 24 establishes the uniform thickness 26 for the tab 24, which continues along the remaining portion of the tab having a flat surface along the top edge 30 as shown in FIG. 4 with a curvature radius 42 equal to radius 40 between the bottom edge 32 and flat side faces 44.

Referring once again to FIG. 2, with a typical onset flow angle θ, three types of cavitation patterns occur because of flow separation at the leading edge 16 and forward nose 35 of the tab into suction regions along a suction side face 46 and a pressure side face 48 of the tab. As a result of such flow separation, one of the cavitation patterns designated tip nose cavitation (TNC) occurs. Above a certain rudder attack angle θ, a second cavitation pattern designated pressure side vortex cavitation (PSVC) appears along the pressure side face 48, while the third cavitation pattern designated suction-side vortex cavitation (SSVC) appears along the suction side face 46 as a result of separation flow cross-over with increasing rudder angle θ. Establishment of such cavitation patterns are suppressed or prevented at low or intermediate speeds of the marine craft 12 by design of the tip tab 24 as hereinbefore described and hereinafter pointed out. Accordingly, rounding of the tab at nose 35 and selection of a most desirable tab thickness 26, as 2% of the rudder span 28, suppresses TNC cavitation of the rudder 10 with increasing velocity imparted to the marine craft up to its maximum speed.

As noted in FIG. 1, because of the thickness 26 of the tab as 2% of the rudder span 28 and the rounding of the tab nose 35, vortex cavitation along the side faces 46 and 48 is delayed. Also, because of the similarity in shape of the wider tab profile to that of the rudder tip 14, PSVC and SSVC types of vortex cavitation are suppressed. Rounding of the tip tab 24 in cross-section to form semi-circular side faces along the distance 38 from its forward nose 35, as shown in FIGS. 1 and 3, avoids cavitation resulting from suction pressure peaks produced during marine craft maneuvering. Rounding of the tip tab 24 in cross-section from its bottom edge 32 to the flat side faces 44 of the tab along the rest of its chordal length 34, as shown in FIGS. 3 and 4, contributes to the suppression of the aforementioned PSVC and SSVC cavitation by dramatic reduction in suction pressure. Further suppression of such PSVC and SSVC cavitation is effected by the sharp corner formed between the flat surface portion of the top edge 30 and side faces 44 rearwardly along the tab 24 from its forward end portion of distance 38 to its rear end beyond the trailing edge 18 at the end tip 14 of the rudder.

The effectiveness of the present invention in suppressing vortex cavitation as hereinbefore described, was demonstrated by evaluation of the tip tab 24 on a rudder 10 associated with a typical marine vessel undergoing comparative cavitation testing in a 24-inch variable pressure water tunnel. FIG. 5 graphically diagrams the rudder pressure distribution for a rudder attack angle of 10° by pressure and suction side plots 54 and 56 of computed pressure coefficients (Cp) along ordinate 50 against fractions of the profile chordal length 34 (Xc) along abscissa 52. Computation of such pressure coefficients (Cp) is disclosed in U.S. Pat. No. 5,415,122.

Figure 6B:
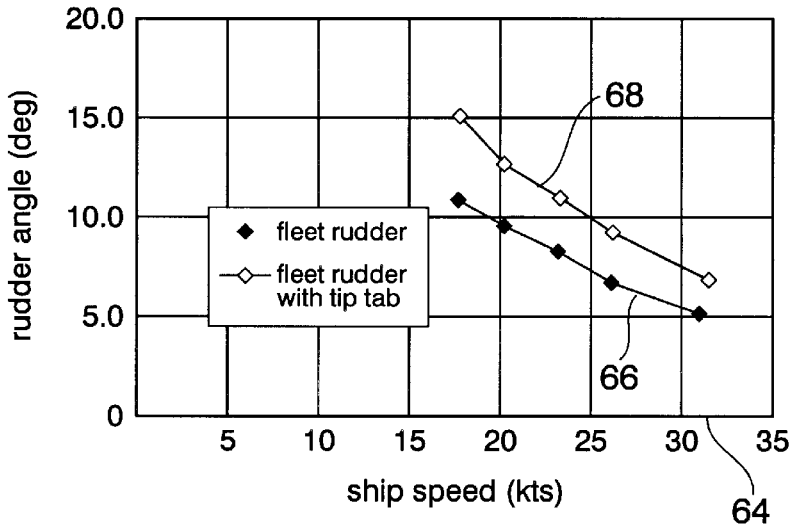

FIG. 6B graphically diagrams the effect of the tip tab 24 on SSVC cavitation by plots 66 and 68 respectively indicating detection of SSVC cavitation on a fleet rudder 10 alone and with the tip tab 24 thereon, in terms of increasing rudder angles denoted along ordinate 62 at different ship speed (kts) detonated along abscissa 64. For the fleet rudder 10 alone, SSVC cavitation was detected at a rudder angle of 11° for a ship tunnel speed of 17.5 knots as diagrammed by plot 66. With the addition of the tip tab 24, SSVC cavitation was not detected until the rudder angle reached a higher value of 15.1° as shown by plot 68. Such delay or suppression of SSVC cavitation on the tip tab 24 was observed throughout the whole test range of ship tunnel speeds.

Figure 6A:
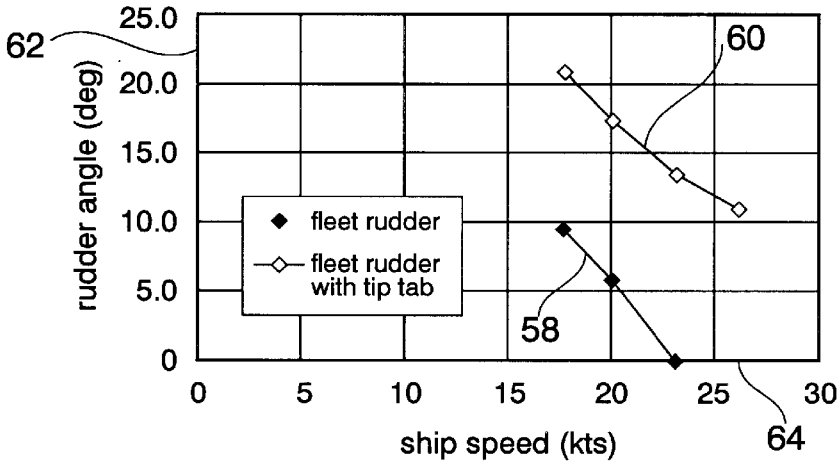

FIG. 6A graphically diagrams by means of plots 58 and 60 detection of PSVC cavitation with respect to fleet rudder 10 alone and with the tip tab 24 thereon. For a tunnel speed of 17.5 knots, the rudder 10 alone experienced PSVC cavitation at a rudder angle of 9.7° as shown by plot 58, as compared to 21° before such cavitation was experienced by the rudder with the tip tab thereon as shown by plot 60. Such cavitation suppression or delay reflected by plots 58 and 60 allows a ship to undergo a tight turn without experiencing PSVC cavitation.

As to TNC cavitation, it was experienced together with PSVC cavitation at speeds greater than 23 knots on the nose of fleet rudder 10 set at a zero degree angle for cruise along a straight course. With the tip tab 24 applied to the rudder in accordance with the present invention, no TNC cavitation occurred at rudder angles less than 13.7°. Furthermore, the test data showed that up to speeds of 31 knots along a straight course (or zero degree angle), no TNC cavitation occurred.

Figure 7A:
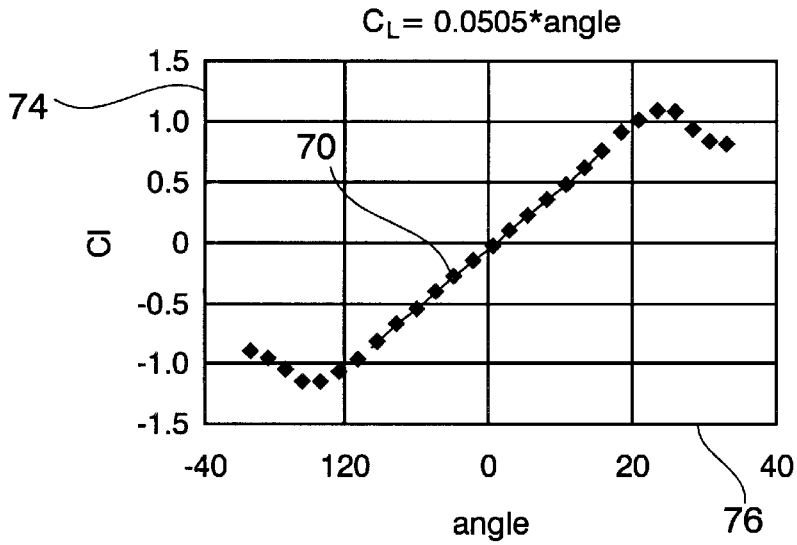
Figure 7B:
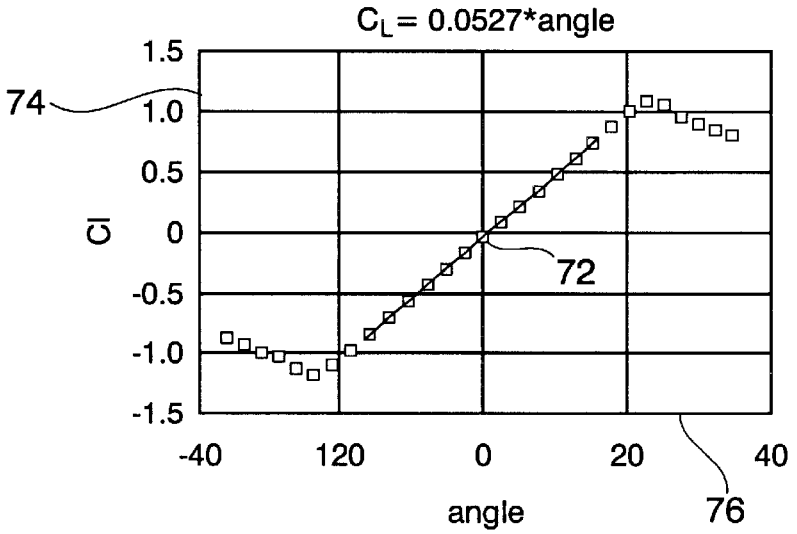

FIGS. 7A and 7B respectively diagram measured lift forces on fleet rudder 10 alone and with the tip tab 24 thereon by means of graphical plots 70 and 72 reflecting variations in lift coefficient (Cl) along the ordinate 74 against rudder angle along the abscissa 76. Because of the end plate effect, the lift slope reflected by plot 72 is 4.5% greater than that for plot 70. Accordingly, a ship having a rudder equipped with the tip tab 24 will have a 4.5% greater side force, to improve ship maneuvering and control.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a marine vessel mounting a hydrofoil shaped rudder having a cross-sectional profile extending between leading and trailing edges of the rudder within a body of water through which onset of water flow is established on the rudder at an angle to a chordal axis of said profile extending between said leading and trailing edges which terminate at an end tip of the rudder, a tab fixed to said end tip and extending along said chordal axis beyond the leading edge of the rudder, said tab having external surface means geometrically similar and larger throughout in outer cross-sectional profile to that of the rudder for suppressing cavitation of the rudder in response to exposure to the water during said onset of the water flow.

2. The combination as defined in claim 1, wherein the tab has a uniform thickness between top and bottom edges thereof extending along said chordal axis, as a predetermined fraction of vertical rudder span.

3. The combination as defined in claim 2 wherein said external surface means of the tab includes: a rounded surface portion extending rearwardly from a forward nose end of the tab a predetermined distance along the chordal axis, said rounded surface portion having semi-circular side faces between the top and bottom edges projecting laterally from the end tip of the rudder.

4. The combination as defined in claim 3, wherein said external surface means further includes: flat top surfaces extending laterally from the rudder at the end tip rearwardly along the top edge of the tab from the rounded surface portion; and flat side faces extending vertically from the flat top surfaces toward the bottom edge of the tab.

5. The combination as defined in claim 4, wherein said predetermined fraction of the vertical rudder span is approximately 2%, while said rounded surface portion of the tab is approximately 10% in length of the tab along the chordal axis.

6. The combination as defined in claim 2, wherein said predetermined fraction of the vertical rudder span is approximately two percent.

7. In combination with a marine vessel mounting a hydrofoil shaped rudder having a cross-sectional profile extending between leading and trailing edges of the rudder within a body of water through which onset of water flow is established on the rudder at an angle to a chordal axis of said profile extending between said leading and trailing edges which terminate at an end tip of the rudder, a tab fixed to said end tip and extending along said chordal axis beyond the leading edge of the rudder, said tab having external surface means geometrically similar in outer cross-sectional profile to that of the rudder for suppressing cavitation of the rudder in response to exposure to the water during said onset of the water flow, said external surface means of the tab including: a rounded surface portion extending rearwardly from a forward nose end of the tab a predetermined distance along the chordal axis, said rounded surface portion having semi-circular side faces between the top and bottom edges projecting laterally from the end tip of the rudder.

8. The combination as defined in claim 1, wherein said forward nose end of the tab is fully rounded.

9. In combination with a marine vessel mounting a hydrofoil shaped rudder having a cross-sectional profile extending between leading and trailing edges of the rudder within a body of water through which onset of water flow is established on the rudder at an angle to a chordal axis of said profile extending between said leading and trailing edges which terminate at an end tip of the rudder, a tab fixed to said end tip and extending along said chordal axis beyond the leading edge of the rudder, said tab having external surface means geometrically similar in outer cross-sectional profile to that of the rudder for suppressing cavitation of the rudder in response to exposure to the water during said onset of the water flow and a forward nose end that is fully rounded, said external surface means further including: flat top surfaces extending laterally from the rudder at the end tip rearwardly along the top edge of the tab from the rounded surface portion; and flat side faces extending vertically from the flat top surfaces toward the bottom edge of the tab.

10. In combination with a hydrofoil element propelled through a body of fluid, said hydrofoil element having a cross-sectional profile extending along a chordal axis thereof, a tab fixed to the hydrofoil element, and external surface means on the tab geometrically similar in outer cross-sectional profile to that of the hydrofoil element for suppressing cavitation of the hydrofoil element in response to exposure to the fluid during flow onset, said external surface means also including: a rounded surface portion extending rearwardly from a forward nose end of the tab a predetermined distance along the chordal axis, said rounded surface portion having semi-circular side faces between top and bottom edges of the tab projecting laterally from the hydrofoil element.

* * * * *